US006229486B1

(12) United States Patent
Krile

(10) Patent No.: US 6,229,486 B1
(45) Date of Patent: May 8, 2001

(54) SUBSCRIBER BASED SMART ANTENNA

(76) Inventor: David James Krile, 807 Cascade Dr., Riverside, OH (US) 45431

( * ) Notice: Subject to any disclaimer, the term of this patent is extended or adjusted under 35 U.S.C. 154(b) by 0 days.

(21) Appl. No.: 09/391,144

(22) Filed: Sep. 7, 1999

Related U.S. Application Data

(60) Provisional application No. 60/099,778, filed on Sep. 10, 1998.

(51) Int. Cl.[7] ..... H01Q 3/02

(52) U.S. Cl. ..... 343/700 MS; 455/277.1

(58) Field of Search ..... 343/700 MS, 711, 343/712, 714, DIG. 2, 893, 853; 455/562, 277.1, 25; 342/367, 374

(56) References Cited

U.S. PATENT DOCUMENTS 5,552,798 * 9/1996 Dietrich et al. ..... 343/893
5,701,583 * 12/1997 Harbin et al. ..... 455/25
5,708,679 * 1/1998 Fernandes et al. ..... 375/200
5,812,933 * 9/1998 Niki ..... 455/16
5,832,389 * 11/1998 Dent ..... 455/562
5,903,826 * 5/1999 Nowak ..... 455/277.1
5,977,914 * 11/1999 Harano ..... 343/700 MS

* cited by examiner

*Primary Examiner*—Don Wong
*Assistant Examiner*—Chuc Tran

(57) ABSTRACT

A cost effective electronically self optimizing antenna system is provided for use with each subscriber unit in both fixed and mobile wireless applications. The smart antenna consists of multiple antenna elements arranged so that individual beams independently cover sections of free space. Collectively, complete coverage of the desired free space is accomplished. The smart antenna uses a relatively narrow beam directed in the appropriate direction thereby reducing interference and improving system capacity. A controller is included which continuously monitors the signal quality and intelligently selects the optimum antenna beam pattern configuration. All telecommunication protocols, both analog and digital, can be accommodated by the controller.

6 Claims, 6 Drawing Sheets

SUBSCRIBER BASED SMART ANTENNA

CROSS-REFERENCE TO RELATED APPLICATIONS

This application claims the benefit of Provisional Application No. 60/099,778 filed on Sep. 10, 1998.

BACKGROUND OF THE INVENTION

1. Field of the Invention

This invention relates to electronically scanned radio frequency (RF) antennas, specifically to such antennas used in fixed and mobile subscriber terminals of wireless radio frequency communication systems.

2. Description of the Related Art

The explosive growth in demand for wireless radio frequency communications necessitates increased efficiency in use of the radio frequency spectrum. In response to the problem extensive efforts have been applied to the development of antenna systems that use some form of scanning technique to improve network performance. Multiple techniques have been demonstrated such as space-diversity combining switched/multiple-beam arrays, RF scanning arrays, and digital beam forming. U.S. Pat. No. 5,903,826 to Nowak, for example, describes a wireless communication system which uses adaptive narrow beam antennas at the subscriber end of the communication link. The technique described in Nowak however is relatively complex and expensive to produce because it requires antennas having multiple polarizations. Further, the technique described in Nowak is geared to fixed access systems, and no claims are made relative to mobile subscriber units. U.S. Pat. No. 5,303,240 to Borras et al describes a similar system but it is limited to Time Domain Multiple Access (TDMA) protocols. The system described in U.S. Pat. No. 5,430,769 to Pasiokas, et al is also similar but limited to transmission and reception of digital data because it depends on the measurement of bit transition times. Each of the described techniques is based on the premise that a more directive beam scanned over a wide angle will result in reduced mutual interference thereby improving system performance for both coverage and capacity. These systems are generally referred to as smart or adaptive antennas that change radiation pattern in response to a changing signal environment.

Implementation of smart antennas at the base station of wireless systems provides narrow beams to be generated for each subscriber or group of subscribers. Consequently, the smart antenna reduces interference by forming nulls in the direction of other sources, thereby improving system capacity and coverage. See, for example, U.S. Pat. No. 5,907,816 to Edward M. Newman et al. The techniques described in Newman's patent also involve forming several narrow antenna beams to improve coverage of the base station. However, the techniques described are not applied at subscriber units. Despite all efforts to date, no subscriber based smart antenna system has been widely accepted primarily because of a failure to produce a cost effective device capable of supporting the large number of fixed and mobile subscribers found within a typical cellsite coverage area. While smart antennas have been applied at base stations, their use is limited due to high cost.

One alternative solution to improve system performance by reducing interference is to provide a stationary highly directive antenna with each subscriber unit. Such a solution has its obvious limitations for mobile subscriber applications stemming from the fact that mobility of the subscriber unit would frequently result in the antenna beam being directed away from the base station transmitting the optimal signal. However, this technique has been implemented in fixed wireless applications in which the subscriber unit is stationary. The solution utilizes a highly directive antenna such as a Yagi-Uda mounted on a roof top for each subscriber unit. The antenna is mounted with the main beam directed at the base station with the strongest signal. Mounting of the antenna requires specialized labor making this a costly solution. Furthermore, this solution is not adaptive to a growing wireless network where increased capacity requires addition of cellsites resulting in fixed subscriber antennas that are no longer directed toward the optimal base station.

SUMMARY OF THE INVENTION

It is therefore an object of the present invention to provide a scanning antenna system suitable for use in all wireless communication applications both analog and digital irrespective of the protocol employed.

It is yet another object of the present invention to provide a scanning antenna system for use with each subscriber unit providing a simple and therefore cost effective means to lower system interference in wireless communications applications.

It is yet another object of the present invention to provide an electronic scanning multi-element antenna system for use with each subscriber unit that cost effectively lowers system interference without the added cost of installation labor in both mobile and fixed wireless applications.

It is yet another object of the present invention to provide a cost effective electronic scanning multi-element antenna system for use with each subscriber unit that is self adjusting in order to avoid the need to manually adjust beam direction in response to a change in optimal base station position or movement of the subscriber antenna system itself.

According to the invention a cost effective electronic scanning multi-element self adjusting antenna system is provided. This antenna system will be utilized as a smart antenna with each subscriber unit in both fixed and mobile wireless applications. Cost effectiveness of the wireless communication system is improved because more subscribers can share a single base station owing to the fact that the smart antenna minimizes mutual interference. Furthermore, implementation of the subscriber based smart antenna is simple and therefore inexpensive. The smart antenna consists of multiple antenna elements arranged on multiple sides of the unit with individual beams independently covering sections of free space such that collectively, complete coverage of the desired free space is accomplished. Each individual antenna element or element array is connected to an electronic switch which has its common port connected to the subscriber unit antenna port. The switch is driven by a controller that intelligently determines which antenna element or elements should be used to obtain the optimal signal. This configuration of the antenna system with its various antenna elements is designated the "optimum configuration". Scanning for the optimum signal is controlled using various algorithms or a combination of algorithms such as periodic scanning, scanning when the signal drops below an absolute threshold, scanning when the signal drops below a relative threshold, and statistically based scanning that compensates for the constantly changing signal environment by utilizing both the directional and space diversity nature of the smart antenna.

DETAILED DESCRIPTION OF A PREFERRED EMBODIMENT OF THE INVENTION

Figure 1:
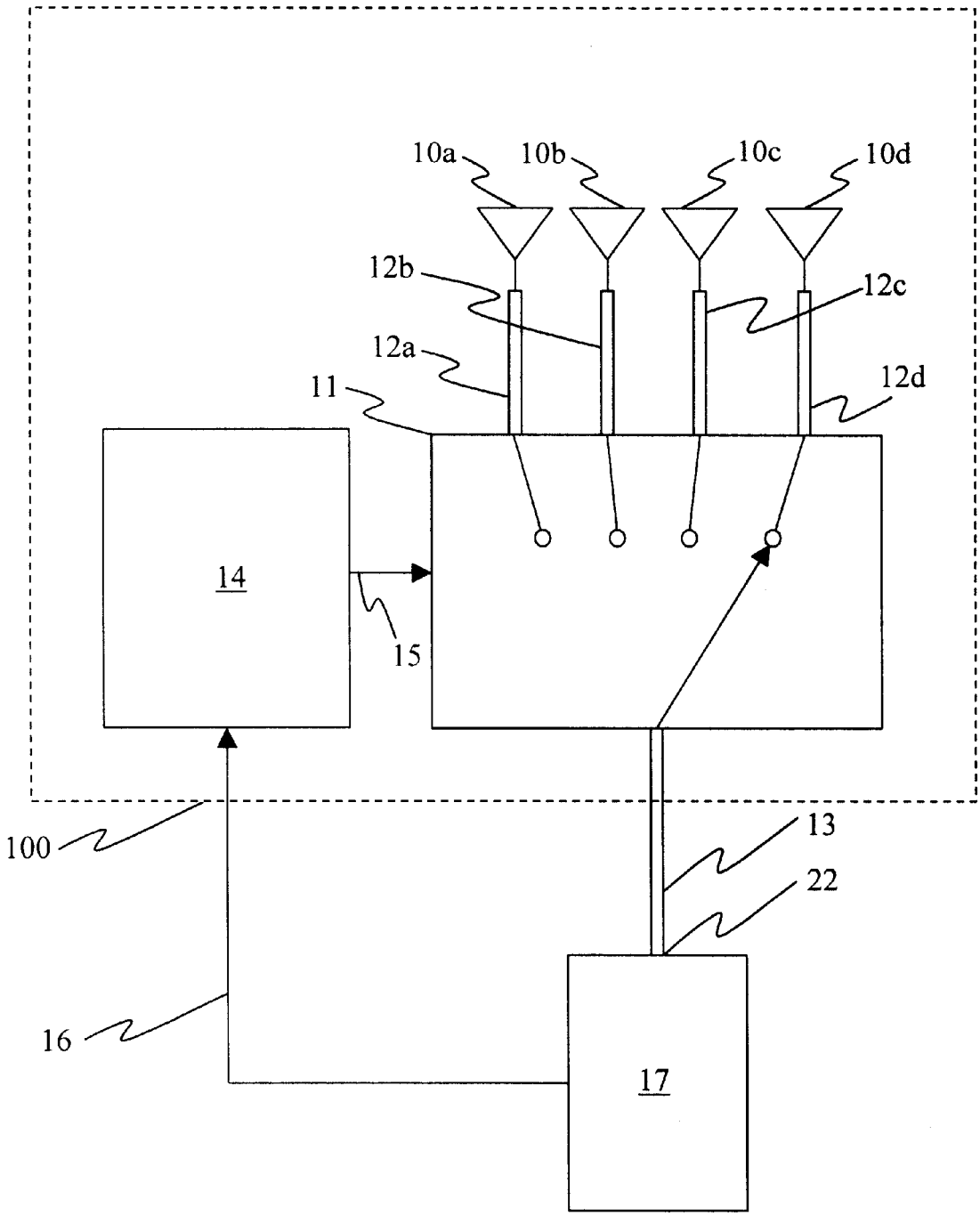
FIG. 1 is a system block diagram of the smart antenna connected to the subscriber unit.

Referring to the drawings, FIG. 1 shows a block diagram of the smart antenna 100 connected to a subscriber unit 17 according to the present invention. The smart antenna consists of four antenna elements, 10*a*, 10*b*, 10*c*, and 10*d*, a radio frequency switch 11, and a controller 14. Each antenna element 10*a*, 10*b*, 10*c*, and 10*d* is connected to the selected port of the RF switch 11 through corresponding transmission lines 12*a*, 12*b*, 12*c*, and 12*d* respectively that transfer RF signals between the antenna elements 10*a*, 10*b*, 10*c*, and 10*d* and the RF switch 11. The common port of RF switch 11 is connected to subscriber unit antenna port 22 through the smart antenna transmission line 13 that transfers RF signals between the RF switch 11 and subscriber unit antenna port 22. The controller 14 is connected to RF switch 11 through a control line 15 that transfers signals from the controller 14 to the RE switch 11 and subscriber unit antenna port 22. The controller 14 is connected to the RF switch 11 through a control line 15 that transfers signals from the controller 14 to the RF switch 11 affecting the selection of antenna element 10*a*, 10*b*, 10*c*, or 10*d*. The controller 14 is also connected to the subscriber unit 17 through a signal line 16 that transfers data regarding received signal quality from the subscriber unit 17 to the controller 14. The controller 14 uses the received signal quality as data to be applied to an algorithm that determines which antenna element 10*a*, 10*b*, 10*c*, and 10*d* to select to obtain an optimal configuration.

Use of a high speed switch (11) allows each antenna to be rapidly sampled in turn and the signal quality produced by each antenna to be measured to determine if the smart antenna should be reconfigured to a new optimal configuration.

Selection of the optimal configuration can be controlled using various algorithms or a combination of such algorithms including, but not limited to selection based on an absolute received signal quality threshold, selection based on a relative received signal quality, and statistically based scanning that compensates for the constantly changing signal environment resulting from such phenomena as fading. The particular selection algorithm utilized in this preferred embodiment of the present invention is based on use of an absolute signal quality threshold. Ultra fast scanning between the antenna elements 10*a*, 10*b*, 10*c*, and 10*d* provides yet another gain in the average signal strength as a result of compensation for fading.

Figure 2:
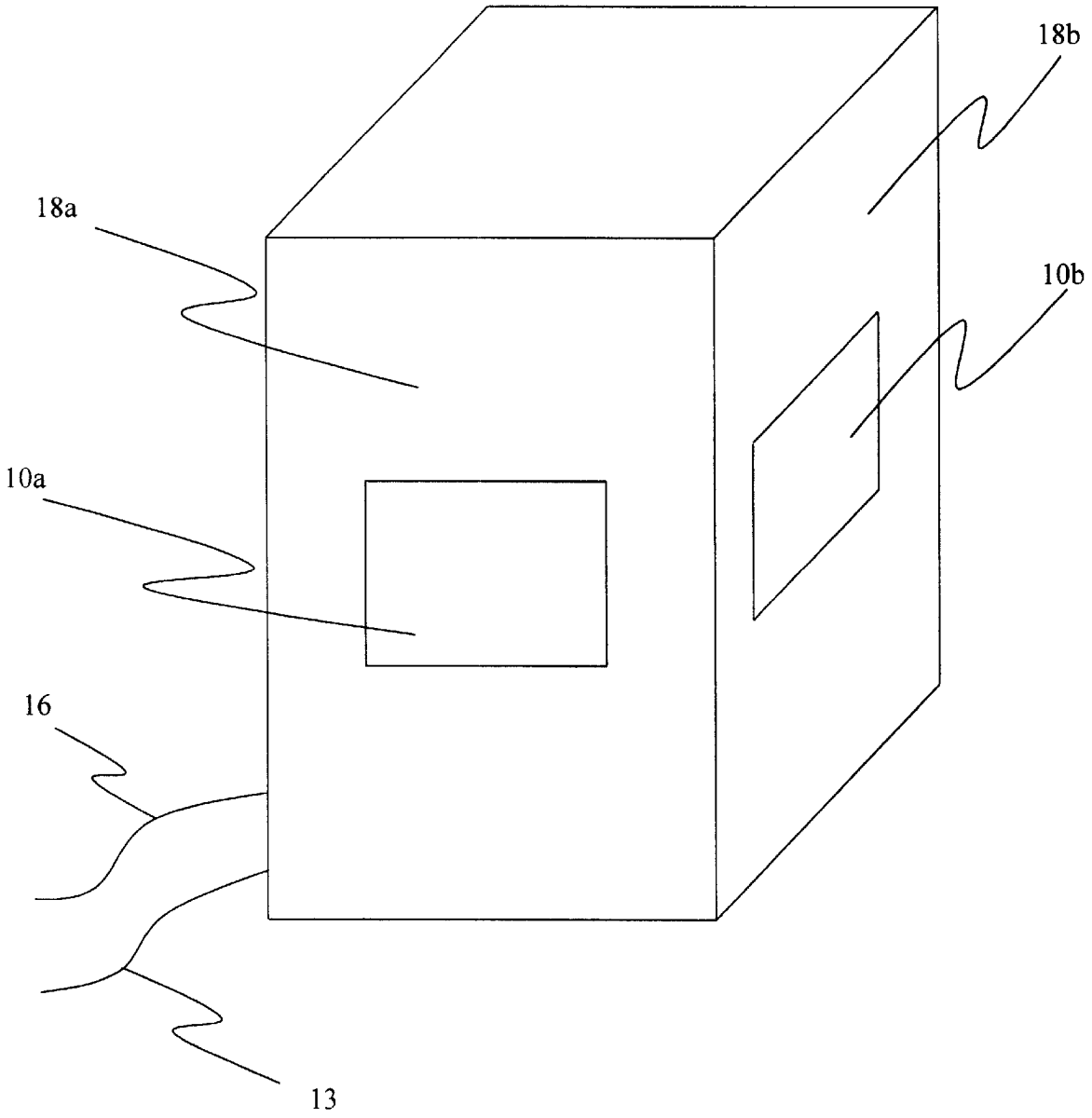
FIG. 2 is an isometric view of the smart antenna according to the invention.

FIG. 2 is an isometric view of the smart antenna according to the present invention. The sides of the smart antenna 18*a* and 18*b* are constructed of electrically conductive material which provide structural integrity and act as the ground planes for the antenna elements 10*a* and 10*b* respectively. Antenna element 10*a* and the corresponding ground plane 18*a* collectively act as a patch antenna providing higher directivity than a conventional monopole antenna. The remaining three sides of the smart antenna each have similar patch antennas providing higher directivity than a conventional monopole antenna. The control signal transmission line 16 and the RF transmission line 13 are shown connected on the outside of the smart antenna.

Figure 3:
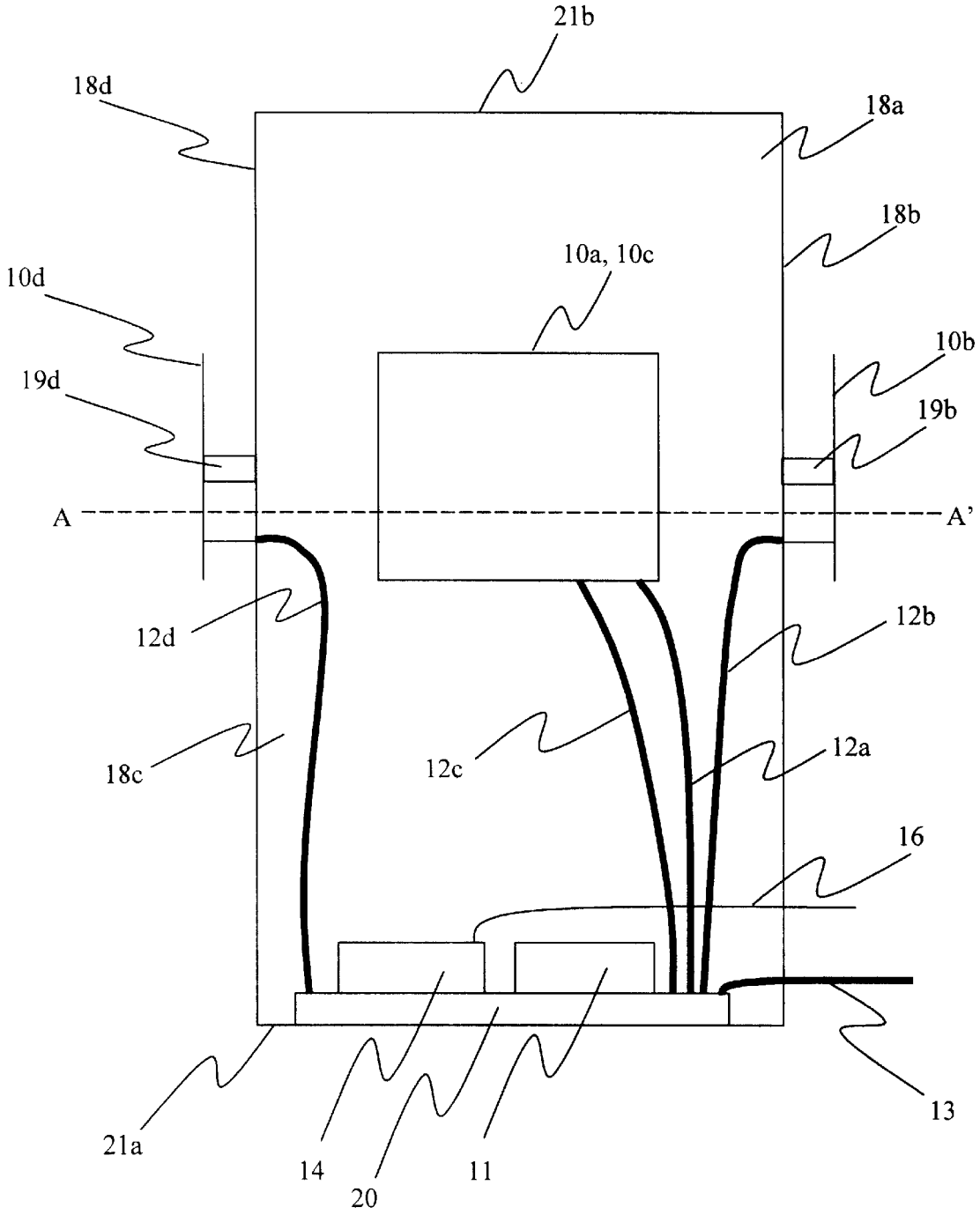
FIG. 3 is a side view of the smart antenna according to the invention.

FIG. 3 represents a side view of the smart antenna with the ground plane 18*a* removed below line A–A' revealing the inside of the smart antenna. The circuit board 20 supporting the controller 14 and RF switch 11 is shown mounted to the bottom 21*a* of the smart antenna. The transmission lines 12*a*, 12*b*, 12*c*, and 12*d* are shown connected to the circuit board 20 at one end and to the corresponding antenna elements 10*a*, 10*b*, 10*c*, and 10*d* respectively at the other end. Note that antenna element 10*c* is hidden directly behind antenna element 10*a*. The top cover 21*b* of the smart antenna provides additional structural integrity.

Figure 4:
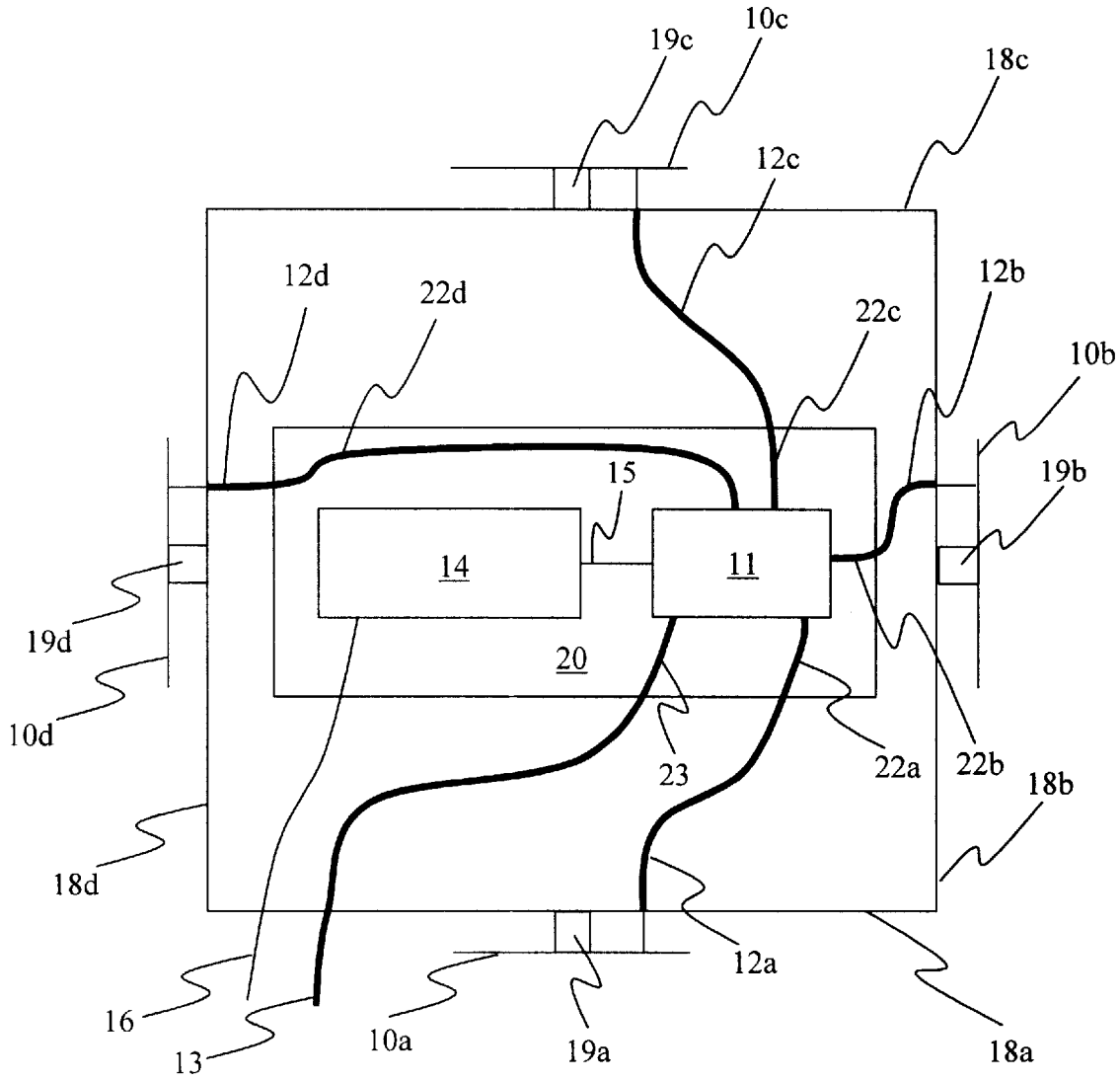
FIG. 4 is a top view of the smart antenna with the top removed in order to show the RF switch and control circuitry.

FIG. 4 represents a top view of the smart antenna with the top cover 21*b* removed revealing the inside of the smart antenna. Each antenna element 10*a*, 10*b*, 10*c*, and 10*d* is separated from the ground plane 18*a*, 18*b*, 18*c*, and 18*d* respectively using a standoff 19*a*, 19*b*, 19*c*, and 19*d* respectively. The standoff is utilized to fasten antenna elements 10*a*, 10*b*, 10*c*, and 10*d* to ground planes 18*a*, 18*b*, 18*c*, and 18*d* respectively in such a way as to provide structural rigidity while simultaneously providing a dielectric layer consisting primarily of air. Each of the antenna elements 10*a*, 10*b*, 10*c*, and 10*d* is connected to the circuit board 20 with transmission lines 12*a*, 12*b*, 12*c*, and 12*d* at the RF traces 22*a*, 22*b*, 22*c*, and 22*d* respectively that connect to the selection ports of the RF switch 11. The common port of the RF switch 11 is shown connected to common port trace 23 which is connected to transmission line 13 which in turn leads to the outside of the smart antenna where it is connected to the antenna port 22 of the subscriber unit.

Figure 5:
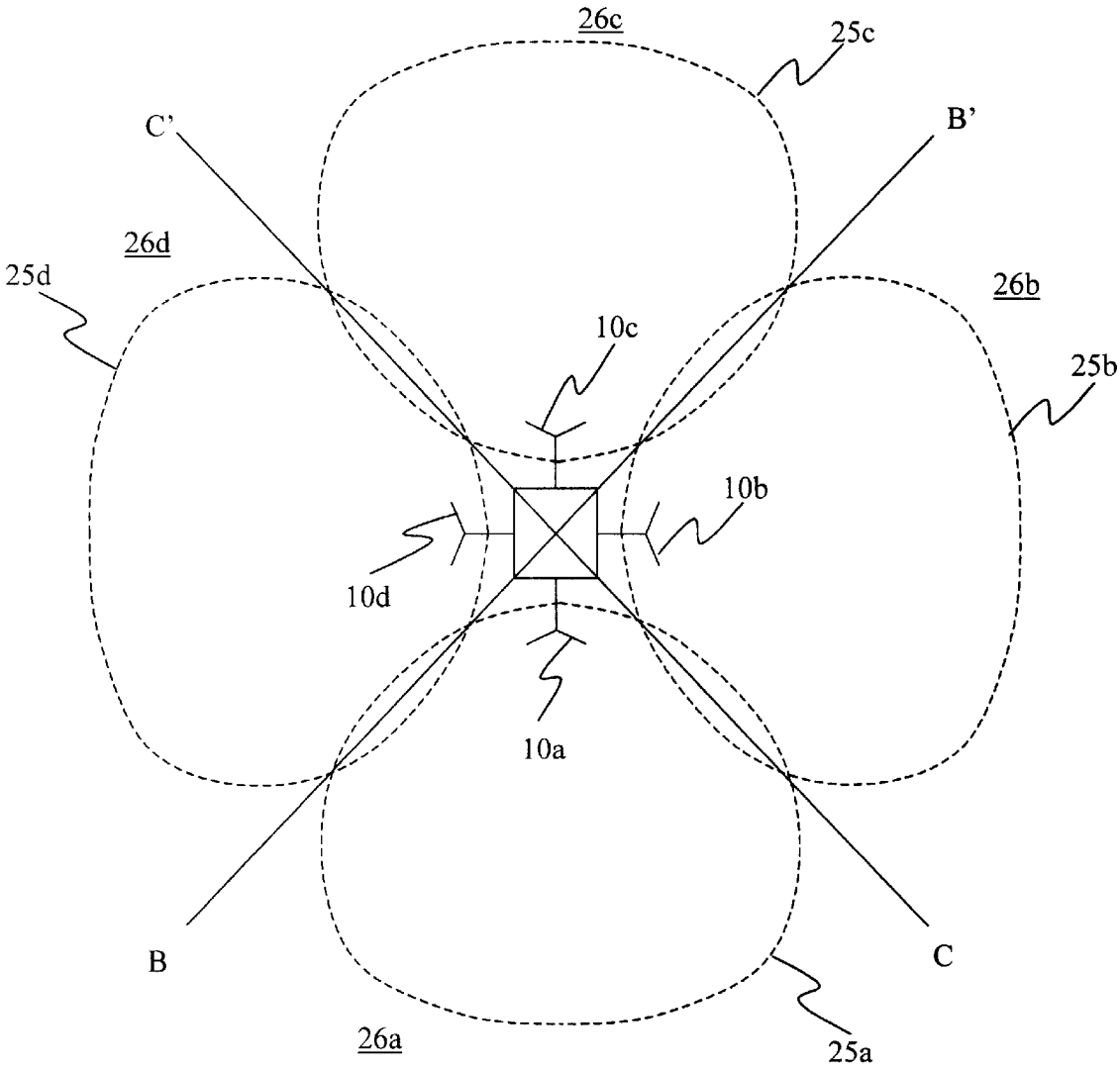
FIG. 5 is an aerial view of the smart antenna coverage pattern.

FIG. 5 represents an aerial view of the smart antenna in order to show the antenna pattern coverage. The entire coverage region is divided into quadrants 26*a*, 26*b*, 26*c*, and 26*d* as divided by lines B–B' and C–C'. The smart antenna is constructed with an antenna element 10*a*, 10*b*, 10*c*, and 10*d* mounted on each of four sides. Each antenna element 10*a*, 10*b*, 10*c*, and 10*d* is designed and mounted such that each of the radiation patterns 25*a*, 25*b*, 25*c*, and 25*d* covers a single quadrant 26*a*, 26*b*, 26*c*, and 26*d*respectively. The optimal configuration is selected from one of these quadrants. By sampling the received signal from each quadrant in turn the entire region is covered.

Figure 6:
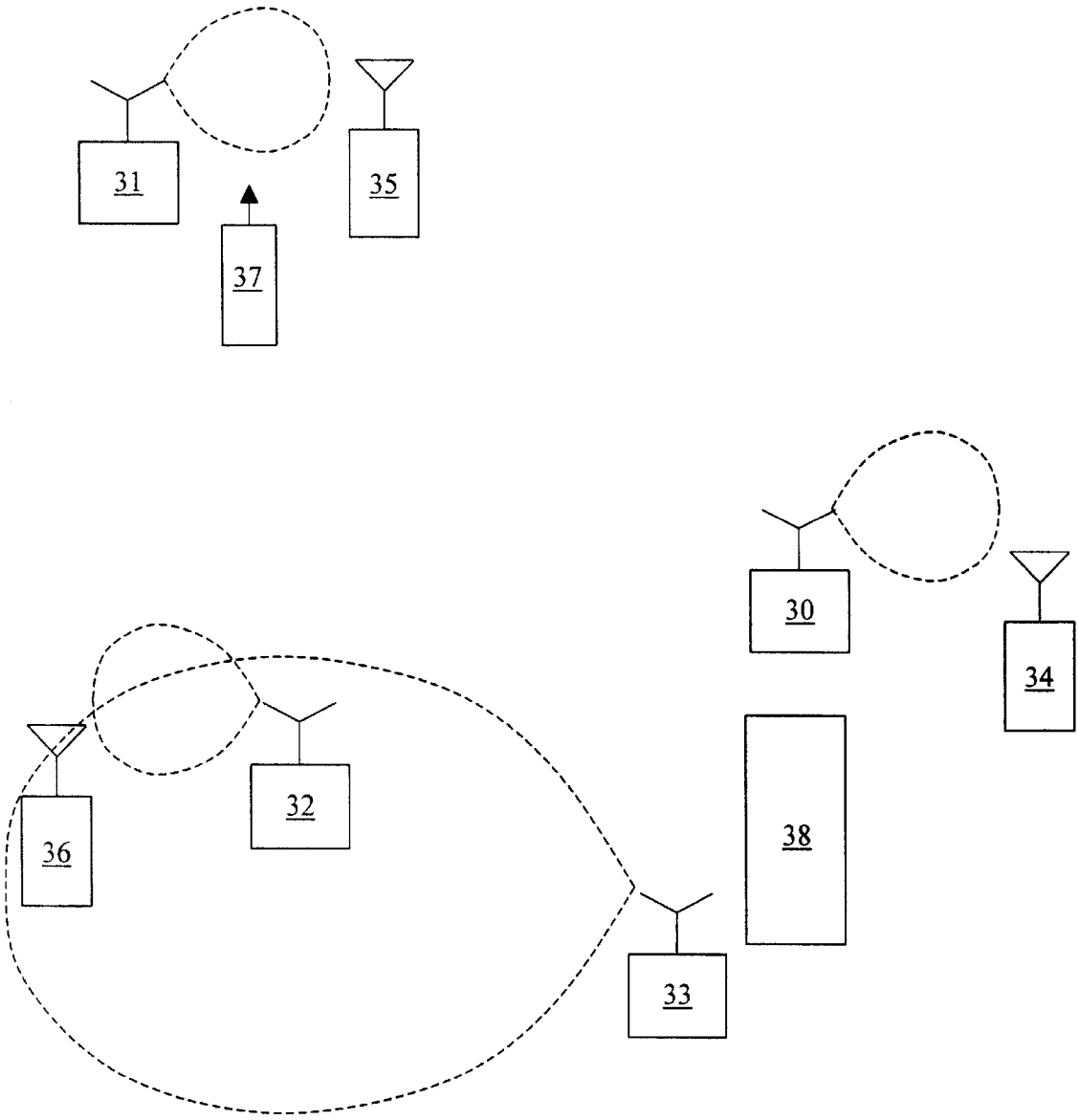
FIG. 6 is a network implementation of the smart antenna at each subscriber unit.

FIG. 6 represents a wireless network implementation of the smart antenna deployed at each subscriber unit 30, 31, 32, and 33. Each subscriber unit 30, 31, 32, and 33 communicates with a base station 34, 35, or 36 by directing its beam towards the base station providing the optimal signal. For example, because of close proximity, subscriber unit 30 selects the antenna element of its associated smart antenna that directs its antenna pattern toward base station 34. As a result, the overall system interference from undesirable signals has been reduced on both the forward and reverse link. The forward link is defined as the communication path from the base station to the subscriber unit while the reverse link is defined as the communication link from the subscriber unit to the base station. Base station 34 receives the majority of the signal transmitted from subscriber unit 30 while base stations 35 and 36 receive little to no signal from subscriber unit 30. Consequently the interference received at base stations 35 and 36 is lowered resulting in higher capacity and coverage for the reverse link. Because subscriber unit 30 has an antenna pattern with improved directivity, a signal gain results on both the forward and reverse link. As a consequence, the subscriber unit 30 can transmit at lower power levels which equates to lower power consumption and longer battery life at the subscriber unit, and lower interference received at the base stations. In a similar manner, the base station 34 can transmit at a lower power level per subscriber resulting in higher forward link capacity. In addition, the signal gain on both the forward and reverse link directly translates to improved coverage.

As a second example, subscriber unit 33 is shown directing its smart antenna beam towards base station 36. This selection could be made as a consequence of the signal blockage caused by obstacle 38 which can represent a building, vehicle, or any structure that attenuates the communication link between subscriber unit 33 and base station 34. Even though subscriber unit 33 is closer to base station 34, it selects the second nearest base station 36 since it provides the optimum signal. The resulting system improvements for capacity and coverage are similar to those described in the prior example.

As a third example, because of close proximity, subscriber unit 31 selects the antenna element of its associated smart antenna that directs its antenna pattern toward base station 35. However, as mobile obstacle 37 moves in the direction of the arrow shown, the attenuation introduced by obstacle 37 could be significant enough to force subscriber unit 31 to redirect its antenna pattern toward base station 36. Once the path between subscriber unit 31 and base station 35 is cleared, subscriber unit 31 redirects its antenna pattern back to base station 35. Note that mobile obstacle 37 can represent a truck or any moving object that introduces attenuation or reflections resulting in a dynamically changing signal environment.

In summary, the subscriber based smart antenna of this invention is a simple, inexpensive antenna system which can improve the performance of wireless radio frequency communication systems. The smart antenna functions in both fixed and mobile networks as well as hybrid networks which are comprised of both fixed and mobile subscriber units. Performance is improved by enabling more subscribers, both fixed and mobile, to simultaneously access the existing base stations, minimizing mutual interference among subscribers, and eliminating the need for any subscriber activity in adjustment of antennas.

I claim:

1. A method for determining the optimal configuration of a directional antenna system allowing access between a fixed or mobile subscriber location and a wireless radio frequency communications system having multiple base stations, where said method comprises the following steps:

for each of a plurality of antenna configurations, receiving the radio frequency signal through said antenna system;

measuring the signal to noise ratio resulting from each of said antenna configurations;

prioritizing the signal to noise ratios of said antenna configurations;

selecting a default antenna configuration from prioritized said antenna configurations;

monitoring the signal to noise ratio of selected said default antenna configuration;

monitoring signal to noise ratios of all said antenna configurations;

switching to another antenna configuration if the signal to noise ratio produced by said selected default antenna configuration fails to satisfy a predetermined criterion.

2. A method for determining the optimal configuration of a directional antenna system as recited in claim 1 where said predetermined criteria is a preset signal to noise ratio.

3. A method for determining the optimal configuration of a directional antenna system as recited in claim 1 where said predetermined criteria is a relative signal to noise ratio.

4. A method for determining the optimal configuration of a directional antenna system allowing access between a fixed or mobile subscriber location and a wireless radio frequency communications system having multiple base stations, where said method comprises the following steps:

for each of a plurality of antenna configurations, receiving the radio frequency signal through said antenna system;

measuring the bit error rate resulting from each of said antenna configurations;

prioritizing the bit error rates of said antenna configurations;

selecting a default antenna configuration from prioritized said antenna configurations;

monitoring the bit error rates of selected said default antenna configuration;

monitoring bit error rates of all said antenna configurations;

switching to another antenna configuration if the bit error rate produced by said selected default antenna configuration fails to satisfy a predetermined criterion.

5. A method for determining the optimal configuration of a directional antenna system as recited in claim 4 where said predetermined criteria is a preset bit error rate.

6. A method for determining the optimal configuration of a directional antenna system as recited in claim 4 where said predetermined criteria is a relative bit error rate.

* * * * *